United States Patent [19]

Tucci et al.

[11] 4,052,718

[45] Oct. 4, 1977

[54] ENCLOSURE ALARM SYSTEM

[76] Inventors: Domenick Tucci, 12 Ridge Road, Mount Kisco, N.Y. 10549; Lewis Cantalupi, 79 Beaumont Circle, Yonkers, N.Y. 10710

[21] Appl. No.: 673,349

[22] Filed: Apr. 2, 1976

Related U.S. Application Data

[63] Continuation of Ser. No. 511,353, Oct. 2, 1974, abandoned.

[51] Int. Cl.[2] ..... G08B 13/08

[52] U.S. Cl. ..... 340/274 R

[58] Field of Search ..... 340/274, 280

[56] References Cited

U.S. PATENT DOCUMENTS

| | | | |
|---|---|---|---|
| 3,193,819 | 7/1965 | Magner | 340/274 |
| 3,453,613 | 7/1969 | Kay | 340/274 |
| 3,852,737 | 12/1974 | Gordon | 340/274 R |
| 3,893,096 | 7/1975 | Tucci et al. | 340/283 |

OTHER PUBLICATIONS

Signal Wiring, Croft, T. McGraw-Hill Book Company, N.Y. 1926, p. 39, Fig. 79. A.V. 234.

*Primary Examiner*—Thomas B. Habecker
*Attorney, Agent, or Firm*—Morgan, Finnegan, Pine, Foley & Lee

[57] ABSTRACT

An alarm system for rigid enclosures such as cabinets, closets, draws, luggage and the like includes an alarm electrically coupled to a direct current source, an on-off deactivating switch, and a pressure responsive switch to provide positive and reliable actuation of the alarm, indicating unauthorized opening of the enclosure. The alarm, current source and deactivating switch may be remote from the enclosure to provide a central security station.

5 Claims, 3 Drawing Figures

ENCLOSURE ALARM SYSTEM

This is a continuation, of application Ser. No. 511,353 filed Oct. 2, 1974 now abondoned.

The present invention relates to alarm systems, and more specifically to an alarm system for rigid enclosures, such as cabinets, closets, draws, luggage and the like.

Various arrangements have been disclosed for providing audible alarm means for detecting unauthorized openings of enclosures, see for example Stelter, U.S. Pat. No. 2,797,405.

With the ever increasing concern over unauthorized access to dangerous, or poisonous substances in the home, particularly small children's access to medicine, a need has been created for a highly reliable yet low cost alarm system.

Accoringly, it is an object of the present invention to provide an improved enclosure alarm system.

It is a further object of the present invention to provide an enclosure alarm system for rigid enclosures which are closed by both sliding and swinging motion of a member of the enclosure.

It is a further object of the present invention to provide an alarm system for enclosures without requiring modification in the construction of the enclosure.

It is a still further object of the present invention to provide an alarm system which is reliable in operation to provide a positive indication of access to the enclosure as well as possibly aiding in deterring the commission of this crime.

It is a still further object of this invention to provide an enclosure alarm system which is inexpensive and yet provides for remote monitoring of enclosure security.

Other objects, aspects, and advantages of the present invention will be apparent when the detailed description is considered with the accompanying drawing.

Drug thefts from doctors' offices and hospitals and related crimes have increased dramatically since 1965 and continues to account for a substantial cash loss. Similarly, accidental poisoning of small infants from household medicines is of constant concern to the public.

The present invention is directed to reducing the high incidence of cash loss caused by drug thieves by providing an alarm system for rigid enclosures such as medicine cabinets or closets and includes a direct current source, an alarm, a deactivating on-off switch, and a pressure responsive switch, all electrically connected in series. The pressure responsive switch is normally held electrically open by a pressure exerted thereon by a component of the enclosure, e.g., a cabinet door. The pressure responsive switch is closed to complete the circuit to the alarm upon removal of the force by opening the enclosure. The on-off switch opens the circuit to the alarm so that access may be had to the enclosure without activating the alarm.

The present invention is illustrated in the accompanying drawing, in which.

Figure 1:
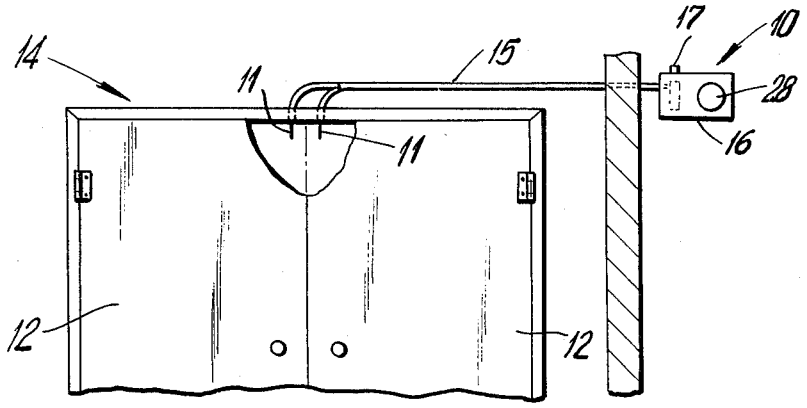
FIG. 1 is a schematic view of one embodiment of the present invention which may be used with a medicine cabinet, and having parts broken away for better illustration.
Figure 3:
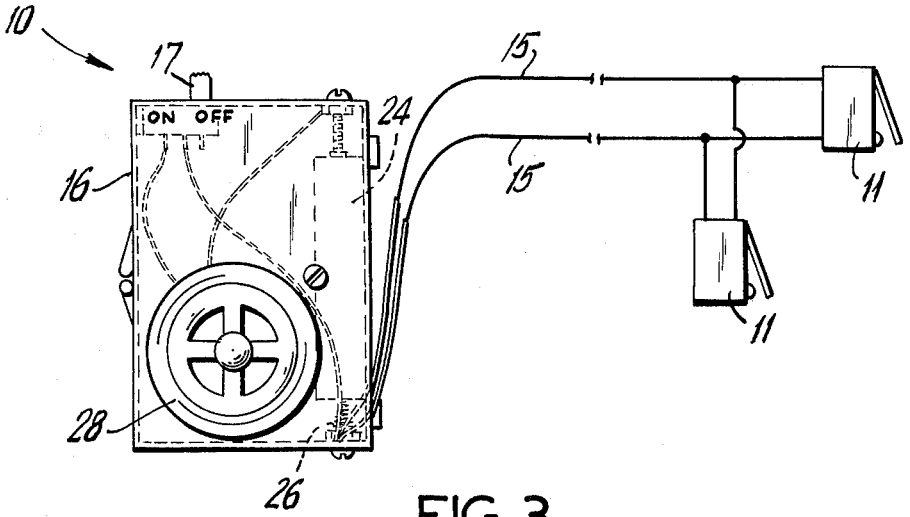
FIG. 3 is a side elevation view of an alarm system of the invention.

Referring to FIGS. 1 and 3, the alarm system is generally indicated at 10, and includes a pressure responsive switch in the form of a switch 11, e.g., a miniature or micro switch, which is mounted interior to the door 12. As shown in FIG. 1, each door 12 of cabinet 14 is provided with a switch electrically connected in parallel by wires 15. The other elements of alarm 10 are contained in a plastic housing 16. A push button or slide switch 17 extends externally from the sidewall of housing 16. (However, if desired, the push button of slide switch 17 may be mounted on one of the side frames of the cabinet.) The lever of switch 11 is advantageously mounted adjacent the door 12 for engagement of the lever thereby when the door 12 is closed. The pressure exerted on the switch 11 by the door 12 holds the lever in a depressed position, so that the switch 20 is electrically open.

Figure 2:
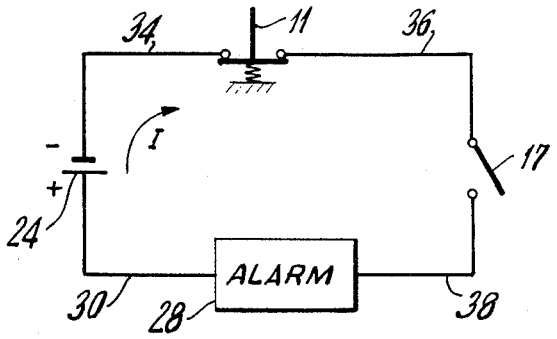
FIG. 2 is a circuit diagram of the present invention.

Referring also to FIG. 2, the alarm system 10 also includes a direct current battery 24, e.g., a 1.5 volt battery, mounted on a suitable support 26. An alarm buzzer 28 is mechanically coupled to the support 26 and has one terminal electrically connected to one terminal of the battery 24 via lead 30. The other terminal of the battery 24 is electrically connected to one terminal of the switch 11 via lead 34. The other terminal of the switch 11 is electrically connected to one terminal of an on-off switch 17 via lead 36 the other terminal of the on-off switch 17 is electrically connected to the other terminal of the alarm buzzer 28 via lead 38. Thus, a series circuit is formed which is activated and deactivated in response to position of switches 11 and 17. The on-off switch 17 is mounted so that it is secreted from view, e.g., on the wall of an adjacent room that it is not easily located and deactivated by an intruder. As best illustration in FIG. 3, where a double door cabinet is equipped with the alarm system a second switch for the second door is connected in parallel with the first switch.

To ready the alarm system 10, the doors 12 are closed to open switches 11. The on-off switch 17 is closed by moving it to the "on" position. The alarm system 10 is now ready for activation. Opening of the door 12 without deactivating the on-off switch 17 will release the depressed lever of the switch 11 causing it to complete the circuit between the battery 24 and alarm buzzer 28, resulting in the emission of an audible sound from the alarm buzzer 28.

The alarm system 10 of the present invention is readily adapted for installation in a wide assortment of rigid enclosures, either temporarily or permanently.

The alarm, current source and deactivating switch may be remote from the rigid enclosure to provide a central security station.

It should be understood by those skilled in the art that various modifications may be made in the present invention without departing from the spirit and scope thereof as described in the specification and defined in the appended claims.

What is claimed is:

1. An alarm system for association with an enclosure which is closed by the movement of a member of the enclosure relative to the remainder of the enclosure to give an audible alarm upon an improper entry into the enclosure by an opening movement of the enclosure member but will be silent upon a proper entry into the enclosure by an opening movement of the enclosure member, said alarm system comprising: a casing member for association with the enclosure, means mounted within said casing member for providing a source of direct current; audible alarm means mounted within said casing member and electrically connected in series to said direct current means; deactivating switch means operatively positioned on the casing member and available for actuation exteriorly from said enclosure and electrically connected in series with said alarm for interrupting the circuit from said direct current means to said alarm means to thereby permit authorized entry into the enclosure by an opening of the enclosure member when desired; and a pressure responsive switch means mounted on the enclosure for direct engagement with and depression by the enclosure member to open said pressure responsive switch means when the enclosure member is in a closed position, thereby placing said alarm means in a deactivated state, said pressure responsive switch means, upon an improper movement of the enclosure member to an open position, closing the circuit between said direct current means and said alarm means, so that such improper opening movement of the enclosure member without a prior deactivating of the alarm by a positive actuation of said deactivating switch means will cause the activation of the audible alarm system to give and continuously maintain an audible noise until the deactivation thereof is initiated by a positive actuation of either the deactivating switch means or the pressure responsive switch means.

2. An alarm system in accordance with claim 5, wherein said deactivating switch means is positioned at a point spaced from said enclosure.

3. The alarm system for association with an enclosure in accordance with claim 1, wherein said enclosure is non-portable and is rectilinear in configuration, said enclosure having a least one enclosure member hingedly secured along a side edge to the remainder of said enclosure to constitute the enclosure member movable relative to the remainder of the enclosure.

4. An alarm system as claimed in claim 1, wherein said pressure responsive switch means includes a switch having a pivotable lever for engagement with the enclosure member when the member is moved to a closed position.

5. An alarm system in accordance with claim 1, wherein said casing member containing said alarm means, deactivating switch means, and direct current source means is positioned at a point remote from the enclosure.

* * * * *